US005474129A

United States Patent [19]

Weng et al.

[11] Patent Number: 5,474,129

[45] Date of Patent: Dec. 12, 1995

[54] CAVITY INDUCED STIMULATION OF COAL DEGASIFICATION WELLS USING FOAM

[75] Inventors: Xiaowei Weng; Carl T. Montgomery, both of Plano; Thomas K. Perkins, Dallas, all of Tex.

[73] Assignee: Atlantic Richfield Company, Los Angeles, Calif.

[21] Appl. No.: 334,908

[22] Filed: Nov. 7, 1994

[51] Int. Cl.[6] ..... E21B 43/25; E21B 43/26

[52] U.S. Cl. ..... 166/308; 166/305.1; 299/16

[58] Field of Search ..... 166/305.1, 308, 166/309, 311, 312; 175/61, 62; 299/16

[56] References Cited

U.S. PATENT DOCUMENTS

| | | | |
|---|---|---|---|
| 4,245,699 | 1/1981 | Steeman | 166/308 X |
| 4,305,464 | 12/1981 | Masszi | 166/308 X |
| 4,913,237 | 4/1990 | Kutas | 166/308 |
| 4,995,463 | 2/1991 | Kramm et al. | 166/308 |
| 5,199,766 | 4/1993 | Montgomery | 299/5 |
| 5,273,115 | 12/1993 | Spafford | 166/308 X |
| 5,390,741 | 2/1995 | Payton et al. | 166/309 X |
| 5,417,286 | 5/1995 | Palmer et al. | 166/308 |
| 5,419,396 | 5/1995 | Palmer et al. | 166/305.1 X |

OTHER PUBLICATIONS

"Cavity Stress Relief Method to Stimulate Demethanation Boreholes", Alain, et al. SPE/DOE/GRI 12843, presented at the 1984 SPE/DOE/GRI Unconventional Gas Recovery Symposium, Pittsburgh, Pa., May 13–15, 1984.

*Primary Examiner*—George A. Suchfield
*Attorney, Agent, or Firm*—Albert C. Metrailer

[57] ABSTRACT

An improved method for stimulating coal degasification wells comprising the injection of a foam into a coal seam which contains natural or induced fractures. Thereafter, high pressure gas is injected into the coal seam and suddenly released to cause disintegration of coal surrounding the borehole.

15 Claims, 1 Drawing Sheet

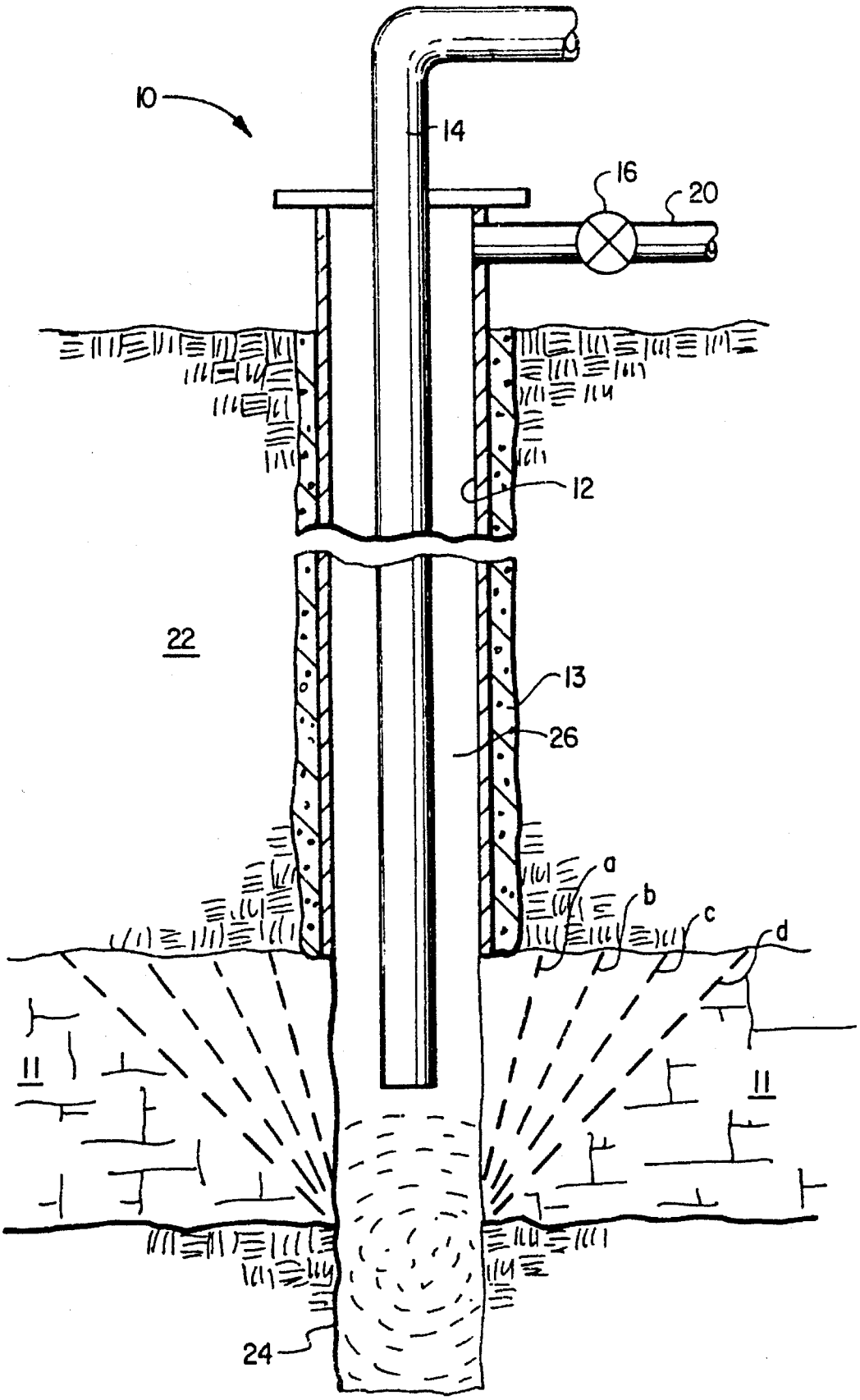
10
14
16
20
12
22
13
26
a
b
c
d
11
11
24

CAVITY INDUCED STIMULATION OF COAL DEGASIFICATION WELLS USING FOAM

BACKGROUND OF THE INVENTION

The present invention relates to the production of gas from a coal seam and more particularly to an improved cavitation process wherein a foam, i.e. a viscous and compressible fluid, is injected into a coal seam followed by injection of high pressure gas which is then released to form a cavity in a coal seam.

Many subterranean coal seams have large volumes of hydrocarbon gases, usually including methane, trapped therein. These gases represent a valuable resource if they can be produced economically. Where a coal seam is to be mined later, it is beneficial from a safety standpoint to produce as much of these gases as possible before commencement of mining operations.

Presently, methane and any other gases are produced from the coal reservoirs through wells which are drilled into the coal seam. Once a well is drilled and completed, it is common to treat the coal seam in order to stimulate the production of methane therefrom. Generally, this involves some method of improving permeability of the coal seam. One such commonly used stimulation treatment involves hydraulically fracturing the coal seam generally in the same manner as used with conventional oil and gas bearing formations, see for example, U.S. Pat. No. 4,995,463.

Another technique which has been proposed for stimulating a coal seam is sometimes generally referred to as "cavity induced stimulation". In this technique, a wellbore is drilled through a coal seam and by use of various techniques a cavity is formed within the seam adjacent the wellbore. As the cavity is formed, the vertical stress component which normally acts on the coal above the cavity is partially transferred to the sides of the cavity which, in turn, causes the coal to become loaded inwardly as the cavity is being formed. This increased load would normally be greater than the natural load bearing capability of the coal and the coal will fail and break up into small fragments. As the coal fragments are removed from the cavity through the wellbore, a large cavity is formed, thereby providing a relaxed zone into which existing fractures can open making the coal and surrounding rock more permeable to gas flow. This technique can be repeated until the bearing capacity of the coal equals or exceeds the redistributed stress. The net effect of forming a cavity into which surrounding coal can collect is the production of a highly permeable zone filled with fine grain coal particles. For a more complete description of the mechanics involved in a typical cavity induced stimulation process, see "Cavity Stress Relief Method to Stimulate Demethanation Boreholes" A. K. Alain and G. M. Denes, SPE/DOE/GRI 12843, presented at the 1984 SPE/DOE/GRI Unconventional Gas Recovery Symposium, Pittsburgh, Pa., May 13–15, 1984. The cavity used in the above-described technique can be formed in different ways. For example, in the above-cited paper, the cavity in the coal seam is disclosed as being formed by jetting water from the lower end of a dual drill-type string while using compressed air to remove the resulting coal fragments.

Another known technique which has been used to form a cavity in a cavity induced stimulation method involves the use of compressed air, nitrogen or other available gases. A wellbore is drilled and completed into a coal seam. A tubing string is then lowered into the wellbore and the well annulus is closed. Compressed gas is supplied through the tubing string to build up a high pressure in the coal seam adjacent the wellbore. The wellbore is then opened to suddenly vent the pressure, thereby allowing the gas within the cleats or fractures of the coal seam to expand and produce a back pressure which overcomes the induced hoop stress within the coal. Under proper conditions, the result of the sudden release of gas is that the coal fails and breaks into fragments which are then removed from the tubing string. This process can be repeated until the desired permeable zone is formed within the seam.

While this gas cavitation process has increased the initial methane production in some wells by as much as four to five fold, when compared to wells which were hydraulically fractured, it has also been shown that this stimulation technique has not worked in other wells. As taught in U.S. Pat. No. 5,199,766 this failure may be due to the cleat density being much less than it was in the successfully completed wells and large hoop stresses induced in the coal during the drilling process. The lower cleat density increases the strength of the coal sufficiently that these hoop stresses cannot be overcome with the normal gas cavitation completion techniques. According to that patent, a solvent such as ammonia is injected into the coal seam and allowed to dissolve materials from the cleat structure for a period of time sufficient to weaken that structure. After the cleat structure is thus weakened, the cavity induced stimulation technique has been found to effectively stimulate the coal degasification.

In two other situations the gas cavitation process has also been found to be unsuccessful. The process was not effective in wells which had been previously hydraulically fractured as discussed above. In general, the process has not been considered applicable to previously hydraulically fractured wells, because such wells are cased through the coal seam with the fracturing process, and gas production, occurring through perforations formed in the casing adjacent the coal seam. Similar results occurred where the formation contained highly conductive natural fractures.

SUMMARY OF THE INVENTION

The present invention provides a cavity induced stimulation method for improving the production of fluids such as methane from a subterranean coal formation or seam. In carrying out the method, a well is drilled to a point adjacent a coal seam and is cased to that point. The wellbore is then extended beyond the cased wellbore and into the seam. A compressible and viscous fluid, i.e. foam, is then pumped into the coal seam to a depth corresponding to the desired cavity size. The foam may be displaced into the seam by use of compressed gas. A gas such as air or nitrogen is pumped at high pressure down the wellbore and into the coal seam as in a conventional gas cavitation process. When an appropriate gas pressure is established in the formation surrounding the wellbore, the gas pressure is suddenly released to allow the pressurized gas to flow back from the formation and break the coal into fragments which then can be removed through the wellbore. The process may be repeated as appropriate to increase the cavity size, if desired.

The present invention has also proved useful as a recompletion technique for wells which were originally completed by casing through the coal seam and hydraulically fracturing the coal seam through perforations formed in the casing adjacent the coal seam. A window in the casing may be milled to allow drilling of a sidetrack open borehole through the coal seam so that the above described process may be performed. The same process may also be performed through the perforations to form a cavity in the coal seam around the perforated casing.

BRIEF DESCRIPTION OF THE DRAWING

The present invention may be better understood by reading the following detailed description of the preferred embodiments with reference to the accompanying drawing which is an elevational view, partly in cross section, of a subterranean coal seam or formation with a wellbore completed therein for practice of the foam enhanced cavity induced stimulation method of the present invention.

DESCRIPTION OF THE PREFERRED EMBODIMENTS

As noted above, the gas cavitation process has proven to be less effective, or completely ineffective, in coal seams which contain natural or artificial fractures. We believe that the fractures interfere with the process both during injection of gas and during the depressurizing step. During gas injection the fractures divert the gas from the coal matrix into the fractures, away from the borehole and make it more difficult to establish the desired high pressure conditions. During the depressurizing step, the fractures again divert the gas around the coal matrix and allow a rapid loss of pressure without generating a desired backstress on the coal which is required to cause failure of the coal seam. We have overcome these problems by injection of a compressible fluid, i.e. a foam, into the coal seam prior to injection of high pressure gas in the cavity induced stimulation process. Inclusion of a gelling agent in the foam should further increase its effectiveness primarily by stabilizing the foam, but this has not proven necessary in initial testing. The foam preferentially flows into the fractures, reducing their effective permeability and thereby diverts gas injected during the gas cavitation process into the coal matrix and allows the desired establishment of a high gas pressure zone near the wellbore. Likewise, during the depressurizing step, the foam prevents the rapid loss of the gas through the fractures and allows it to apply the proper forces to the coal matrix as desired.

With reference to the FIGURE, there is illustrated a wellbore 10 which has been drilled to and completed in a coal seam 11. Preferably, the well is first drilled through the overlying earth formations 22 to the top of coal seam 11. Surface casing 12 is then installed and sealed in place by cement 13. The lower open portion of the borehole 24 is then completed through coal seam 11. A tubing 14 is installed to provide a means for circulating fluids from the lower end of the borehole. A valve 16 and conduit 20 are provided in communication with the annulus 26 between tubing 14 and casing 12. For example, air or other fluids may be flowed down tubing 14 and returned through annulus 26 to remove any materials remaining in the open borehole section 24 before the stimulation process is commenced. It is also preferred in the present invention that all liquids in the lower open hole section 24 be displaced with air.

After thus cleaning out the borehole 10, a foam forming fluid is pumped down tubing 14 to the open hole section 24 of borehole 10. The foam forming fluid is pumped into the coal seam at matrix rates, that is below the minimum in situ stress. Compressed air or nitrogen is then pumped down tubing 14 to displace the foam forming fluid from the borehole into the coal seam 11. As the fluid is displaced by the gas, the foam is formed in situ. The quantities and types of materials are selected based on type of coal and the desired depth of penetration of foam, typically from about five to about eight feet from the borehole. In a typical case, this would require about 12 to 15 barrels of foam forming liquid for a 25 foot thick coal seam with 5% porosity.

Foams which are believed suitable for this purpose include a foam composed of water, surfactant and one or more of air, nitrogen and $CO_2$. Suitable surfactants include coco-trimethyl quaternary amines, perflourinated quaternary ammonium iodide, nonylphenol +10 mols of ethylene oxide. The foam may be stabilized by addition of a gelling agent including guar, guar derivatives, cellulose, cellulose derivatives, xanthan, and xanthan derivatives. These materials are believed to be useful at ambient conditions, that is, they do not require application of additional heat or extreme pressures.

A foam of 70 to 80 quality is preferred for this application. For the purposes of this process this means a foam which is 70% to 80% gas by volume and 20% to 30% liquid at downhole conditions. A typical foam forming fluid would be made by mixing 0.2% to 0.5% by weight of nonylphenol +15 mols of ethylene oxide with water, or two to five gallons per thousand gallons of water. In a typical well, ten barrels of this foam forming fluid would be injected from the borehole into the coal seam and then displaced with 500 to 600 standard cubic feet of gas per barrel of fluid to form the foam in situ. The optimum quantity, concentration and viscosity of the foam will depend on seam thickness and coal type and properties.

After the foam is injected, a gas such as air or nitrogen is pumped down tubing 14 at high pressure, but below formation fracture pressure, and into the coal seam 11. Note that this gas injection step can be simply a continuation of the gas injection which forms the foam in place. As in a normal gas cavitation process, pumping is continued until a sufficient bottom hole pressure is achieved and high pressure gas has penetrated sufficiently far into coal seam 11. Valve 16 is then opened to allow high pressure gas to be released from the wellbore 10 through conduit 20 to suddenly drop the wellbore pressure. The foam treatment reduces the diversion and loss of injected gas in the coal seam 11 during the injection process allowing the desired pressure buildup. The foam also prevents a rapid bleedoff of the pressurizing gas through highly permeable fractures during the depressurizing step to thereby prolong the tensile action on the coal. As a result the gas flowing back out of seam 11 will cause the desired cavitation about the borehole 10. The coal particles generated by the process may then be removed from the borehole by circulation as done at the beginning of the process.

The present invention was developed and initially tested to recomplete wells which were originally completed and stimulated by hydraulically fracturing. These wells differ from the preferred completion technique in that they are normally cased through the coal seam. The casing is perforated adjacent the coal seam to provide communication between the borehole and the coal seam for the injection of hydraulic fracturing materials and for production of gas. In the initial tests of the present invention the casing was removed partly in the coal seam by a conventional milling process to provide an opening or window for drilling a sidetrack well from the original wellbore. After thus opening the casing and drilling a sidetrack in the coal seam, the well is functionally the same as the preferred embodiment shown in the FIGURE. That is, the well is cased to the top of, but not through, the coal seam and the wellbore continues through the coal seam as an open hole completion. The open hole portion of the well is normally in the portion of the coal seam which was fractured by the previous hydraulic fracturing completion process. After this sidetracking step, the process described above was carried out in the well. In the first test well, flow rate was improved from 930 MCFPD to 1.5 MMCFPD, that is, it was increased by a factor of 1.6 as compared to the production from the same well after hydraulic fracture stimulation. In the second test well, flow rate was improved from 800 MCFPD to 1.4 MMCFPD, that is, it was increased by a factor of 1.75 as compared to the production from the same well after hydraulic fracture stimulation.

In the initial testing we used as a foam forming fluid a blend of materials identified by the contractor, Halliburton Well Services, as ⅓ "SSO-21" and ⅔ "AQF II". The description of these materials, as given by the contractor is: "SSO-21" is a microemulsion of 71% (50% ethylene glycol monobutyl ether +50% of a $C_8$ Alcohol reacted with 2 moles of ethylene oxide) +14.5 % (50% active nonyl phenol alkyloxylated with 20 moles of ethylene oxide) +14.5 % (2-ethyl hexanol); and "AQF II" is generically described as a alkyl olefin ($C_{14}$ to $C_{16}$) sulfonate.

After the initial testing, we have found that the relatively expensive milling and sidetracking process is not necessary for effective recompletion of wells previously completed and stimulated by conventional hydraulic fracturing techniques. The process of the present invention can effectively be performed through the original perforations in the casing. We believe that it is desirable to add additional perforations in the casing adjacent the coal seam and have done so in testing the present invention. We have successfully recompleted such wells by adding perforations and then applying the foam enhanced cavity induced stimulation process described above through the perforations. The process effectively breaks the coal into particles small enough to be produced through the perforations so that a cavity is formed around the borehole outside the casing. Initial testing indicates formation of good cavity completion and improved flow, but actual flow rate measurements are not available.

As an alternative to sidetracking the wellbore, or recompleting through the perforations, it would be possible to remove all of the original casing in the coal seam by milling. However this would be the most expensive and most difficult way of reaching the well configuration shown in the FIGURE and is not considered to be practical on economic grounds.

As illustrated by the dash lines a, b, c and d in the FIGURE, the initial cavitation process may typically generate a cavity along lines a. Repeated steps can expand the cavity to the positions b, c and d, as desired.

While the present invention has been illustrated and described with reference to particular apparatus and methods of operation, it is apparent that various changes can be made therein within the scope of the present invention as defined by the appended claims.

What is claimed is:

1. A cavity induced stimulation method of the type in which injection and release of high pressure gas from a subterranean coal seam adjacent a wellbore is used to form a cavity adjacent the wellbore for improving the production of fluids from the subterranean coal seam comprising:

(a) completing a wellbore into said coal seam;

(b) flowing a foam forming fluid down the wellbore to said coal seam and into said coal seam;

(c) flowing a gas down the wellbore and into said coal seam at high pressure to generate foam in situ and to generate an area of high pressure gas in the coal seam adjacent the wellbore; and, (d) releasing the pressure in said wellbore to generate a cavity in the coal seam adjacent the wellbore.

2. The method of claim 1, wherein said foam is displaced into said coal seam to a depth of from about five to about eight feet from said wellbore.

3. The method of claim 1, wherein said foam is a mixture of water and surfactant and at least one gas selected from the group comprising air, nitrogen and CO2.

4. The method of claim 3, wherein said foam also includes a gelling agent.

5. The method of claim 4, wherein said gelling agent is selected from the group comprising guar, cellulose and xanthan and derivatives of guar, cellulose and xanthan.

6. The method of claim 1, further including:

repeating steps (b), (c) and (d) of claim 1 one or more times.

7. A cavity induced stimulation method of the type in which injection and release of high pressure gas from a subterranean coal seam adjacent a wellbore is used to form a cavity adjacent the wellbore for improving the production of fluids from an existing well which has been completed in the subterranean coal seam and used to hydraulically stimulate the coal seam comprising:

(a) flowing a foam forming fluid down the wellbore to said coal seam and into said coal seam;

(b) flowing a gas down the wellbore and into said coal seam at high pressure to generate foam in situ and to generate an area of high pressure gas in the coal seam adjacent the wellbore; and, (c) releasing the pressure in said wellbore to generate a cavity in the coal seam adjacent the wellbore.

8. The method of claim 7, wherein said foam is displaced into said coal seam to a depth of from about five to about eight feet from said wellbore.

9. The method of claim 7, wherein said foam is a mixture of water and surfactant and at least one gas selected from the group comprising air, nitrogen and CO2.

10. The method of claim 9, wherein said foam also includes a gelling agent.

11. The method of claim 10, wherein said gelling agent is selected from the group comprising guar, cellulose and xanthan and derivatives of guar, cellulose and xanthan.

12. The method of claim 7, further including:

repeating steps (b), (c) and (d) of claim 1 one or more times.

13. The method of claim 7, wherein the existing well as originally completed is cased through the coal seam and the casing is perforated adjacent the coal seam, and wherein the method of claim 7 is performed by flowing fluids into and producing fluids from the coal seam through the perforations.

14. The method of claim 13, wherein prior to performing steps (a), (b) and (c), additional perforations are formed in the casing adjacent the coal seam.

15. The method of claim 7, wherein the existing well as originally completed is cased through the coal seam and wherein prior to performing steps (a), (b) and (c), at least a portion of the casing is removed adjacent the coal seam and a sidetrack borehole is drilled through said coal seam.

* * * * *